US007069971B1

(12) United States Patent
Sheng

(10) Patent No.: US 7,069,971 B1
(45) Date of Patent: Jul. 4, 2006

(54) ADHESIVE TAPE DISPENSER

(76) Inventor: Wang Chun Sheng, 2F, No. 50, Taihe St., Cidu District, Keelung City 2056 (TW)

( * ) Notice: Subject to any disclaimer, the term of this patent is extended or adjusted under 35 U.S.C. 154(b) by 0 days.

(21) Appl. No.: 11/060,429

(22) Filed: Feb. 18, 2005

(51) Int. Cl.
*B65H 49/26* (2006.01)

(52) U.S. Cl. ..... 156/577; 156/574; 225/20; 225/33; 206/411

(58) Field of Classification Search ..... 225/19, 225/20, 33, 46, 47, 56, 77; 156/574, 577, 156/579; 206/411; D19/67, 68, 69
See application file for complete search history.

(56) References Cited

U.S. PATENT DOCUMENTS 6,371,403 B1 * 4/2002 Shen ..... 242/598.2
D496,691 S * 9/2004 Crawford et al. ..... D19/69

* cited by examiner

*Primary Examiner*—Mark A. Osele
(74) *Attorney, Agent, or Firm*—Rosenberg, Klein & Lee

(57) ABSTRACT

An adhesive tape dispenser includes a fixed base forming a first cavity in which a movable carrier is removably received. The movable carrier defines a second cavity in which a roll of adhesive tape is rotatably received. The base is provided with a first cutter to cut off a length of tape unwound from the roll when the carrier is retained in the base. The carrier is provided with a second cutter to cut off a length of tape when the carrier is separated from the base to individually serve as a tape applicator.

4 Claims, 4 Drawing Sheets

ADHESIVE TAPE DISPENSER

BACKGROUND OF THE INVENTION

1. Field of the Invention

The present invention generally relates to an adhesive tape dispenser, and in particular to a tape dispenser that allows a user to separate a relative lightweight tape carrier from a heavy base for separate application of tape.

2. The Related Art

A tape dispenser is one of the most common office stationeries, which allows a user to readily withdraw and cut a suitable length of adhesive tape. Conventionally, a tape dispenser has a bulky and heavy body defining a recessed cavity in which a roll of adhesive tape is accommodated in a rotatable manner. The heavy body, which provides a "fixed operation mode" by holding the dispenser at a fixed position, ensures stable positioning of the dispenser on for example a desk, whereby the user may readily unwind and withdraw a length of the tape without causing moving of the dispenser on the desk. However, in certain applications, it may be desired to dispense the adhesive tape in different orientations, which requires a user to position the tape dispenser, by one hand holding the dispenser body, adjacent the object on which the tape is applied, such as an open face of a carton, while pulling the tape with the other hand for application. This is a "movable operation mode", which cannot be easily done with the heavy structure of the conventional dispenser for one has to hold the heavy structure with one hand the pull and unwind the tape with the other hand at the same time.

It is thus desired to provide an adhesive tape dispenser that allows adhesive tape to be withdrawn in different orientations in order to overcome the drawbacks of the conventional tape dispenser.

SUMMARY OF THE INVENTION

Therefore, a primary objective of the present invention is to provide an adhesive tape dispenser that allows for selective application of the dispenser in either fixed operation mode or movable operation mode.

Another objective of the present invention is to provide an adhesive tape dispenser that comprises a movable/removable tape carrier mounted on a heavy base so as to allow for both desk-supported fixed operation mode and hand-held movable operation mode.

To achieve the above objectives, in accordance with the present invention, an adhesive tape dispenser comprises a fixed base forming a first cavity in which a movable carrier is removably received. The movable carrier defines a second cavity in which a roll of adhesive tape is rotatably received. The base is provided with a first cutter to cut off a length of tape unwound from the roll when the carrier is retained in the base. The carrier is provided with a second cutter to cut off a length of tape when the carrier is separated from the base to individually serve as a tape applicator.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
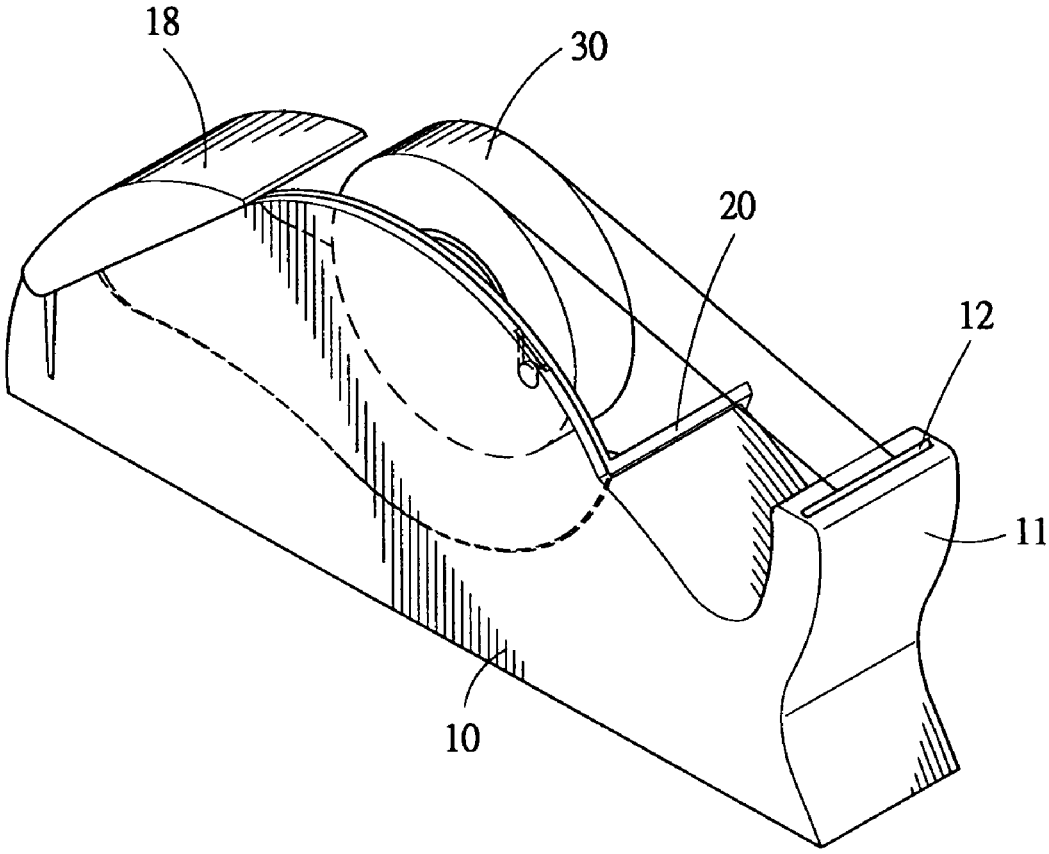
FIG. 1 is a perspective view of an adhesive tape dispenser constructed in accordance with the present invention.
Figure 2:
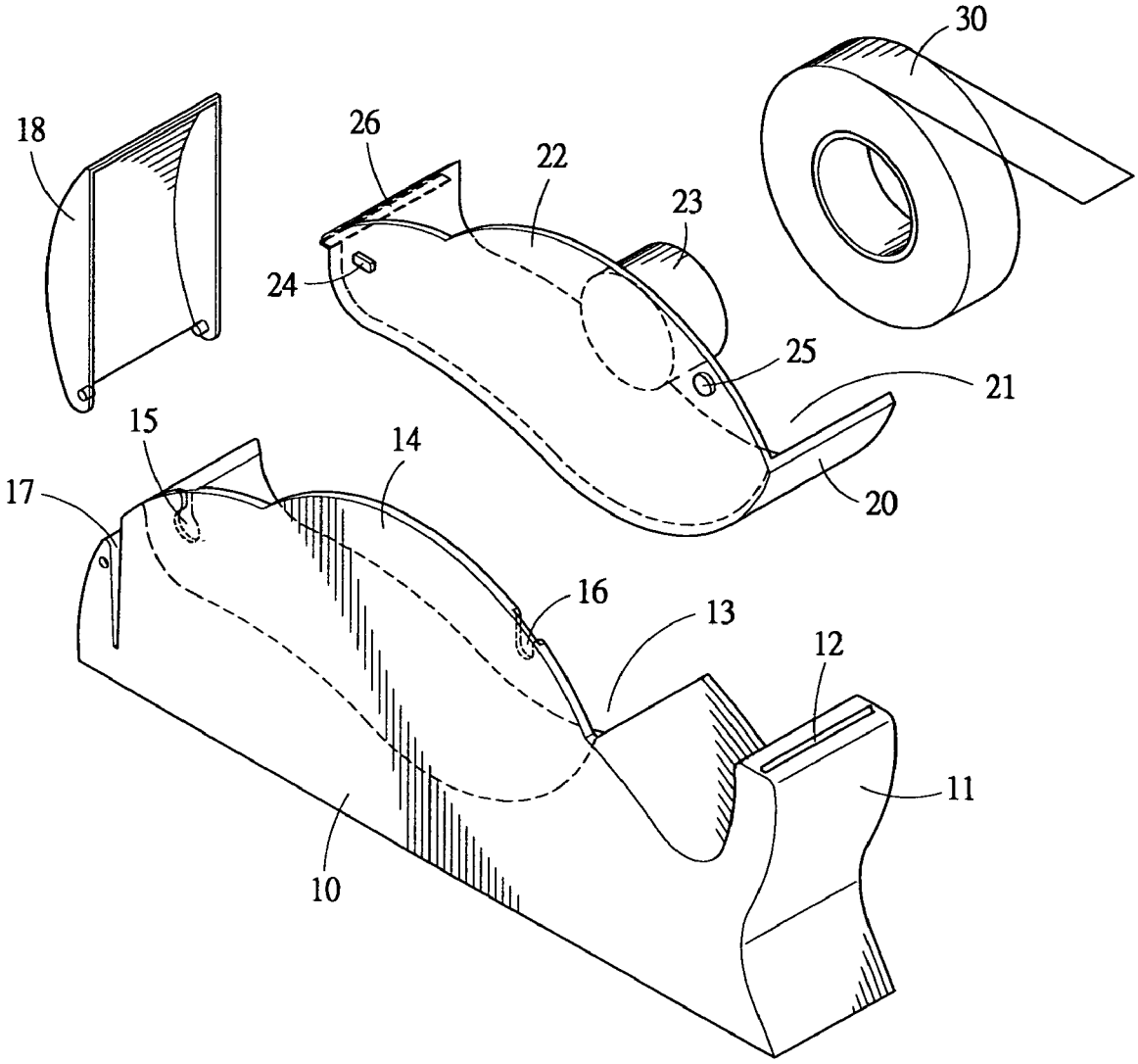
FIG. 2 is an exploded view of the adhesive tape dispenser in accordance with the present invention.

With reference to the drawings and in particular to FIGS. 1 and 2, an adhesive tape dispenser constructed in accordance with the present invention, comprises a stationary base 10 and a movable tape carrier 20 removably mounted to the base 10. The base 10 has opposite front and rear ends. The front end of the base 10 forms a cutter holder 11 in which a first cutter 12 having a cutting blade is mounted with a sharp edge of the blade 12 projecting above a top face of the cutter holder 11. A side wall 14 extends alongside a top face of the base 10 and defines, together with the top face of the base 10, a recessed cavity 13. A first, retention slot 15 and a second positioning slot 16 are defined in the side wall 14, both extending from a top edge of the side wall 14, and are located close to the front and rear ends of the base 10.

The movable carrier 20 has a bottom that is shaped complementary to the cavity 13 of the base 10 whereby the carrier 20 is neatly fit in the cavity 13. A side wall 22 extends from the bottom of the carrier 20 and overlaps against the side wall 14 of the base 10. The side wall 22 and the bottom of the carrier 20 define a cavity 21. An axle 23 is arranged in the cavity 21 and extends from the side wall 22 for rotatably supporting a roll of tape 30 thereon. A first, elongated pivot pin 24 and a second, positioning pin 25 are formed on the side wall 22 of the carrier 20 and are respectively received in the first and second slots 15, 16 of the side wall 14 of the base 10. A rear end of the carrier 20 forms a secondary cutter holder that fixes a secondary cutting blade 26 having a sharp edge projecting above the secondary cutter holder.

To assemble, the roll of tape 30 is fit over the axle 23 and thus accommodated in the cavity 21 of the carrier 20. The carrier 20 is then fit into the cavity 13 of the base 10 with the pins 24, 25 received in the slots 15, 16. With such an arrangement, the tape dispenser can be stably positioned on a fixed surface, such as a desk top. A user may pull a length of tape out of the roll 30 and use the first cutter 12 to cut off the length of tape. This provides a fixed operation mode of the tape dispenser.

Figure 4:
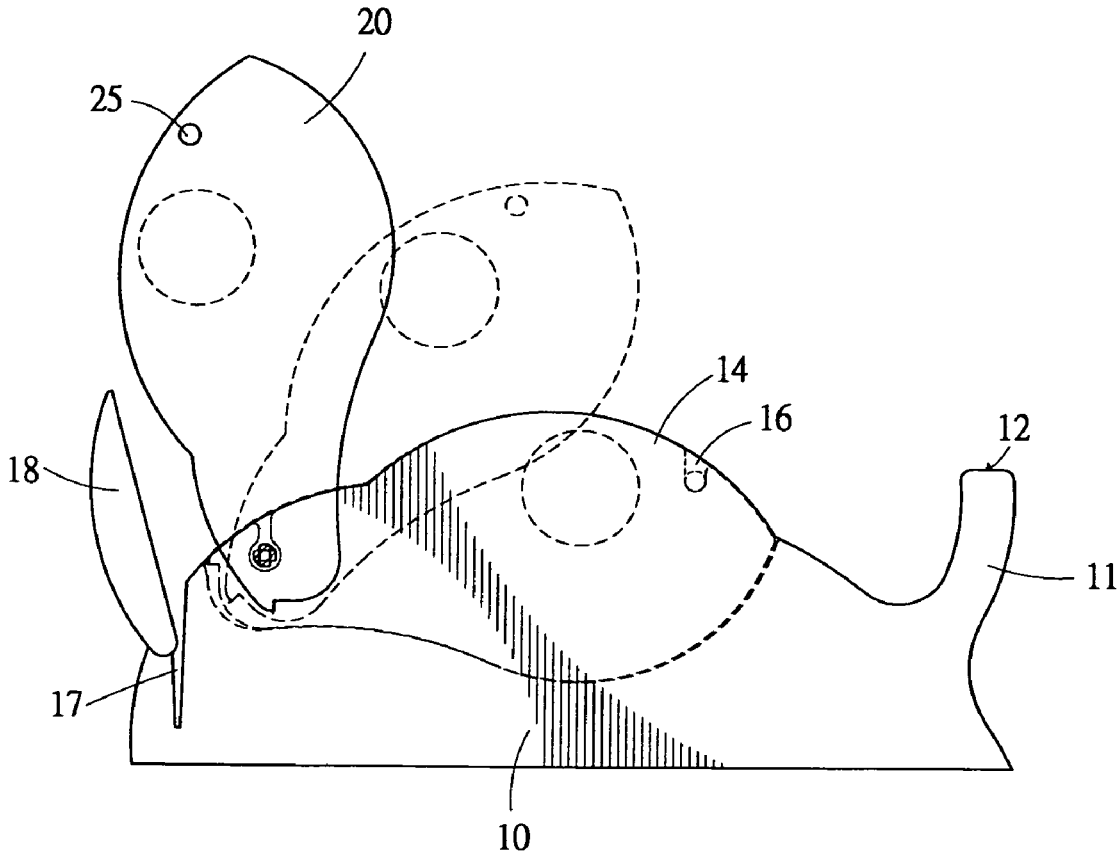
FIG. 4 is a side elevational view illustrating movement/removal of a movable tape carrier of the tape dispenser in accordance with the present invention.

Also referring to FIG. 4, the user may rotate the movable carrier 20 with respect to the fixed base 10 by disengaging the second pin 25 from the second slot 16 and the rotation is carried about an axis defined by the first pin 24. The first pin 24 that is elongated can be removed out of the first slot 15 at a particular angular position of the carrier 20 at which length of the first pin 24 is substantially aligned with the extension direction of the first slot 15. This allows the carrier 20, as well as the tape roll 30 carried thereon, to be detached from the base 10. The user may now hand holds the carrier 20 with much less effort than holding the fixed base 10 that is of a heavy weight for stably positioning on a desk. A length of the tape is then unwound from the roll 30 and cut off by using the secondary cutter 26. This provides a movable operation mode of the tape dispenser.

To ensure smooth rotation of the carrier 20 about the first pin 24, the first slot 15 terminates with an expanded hole, as best seen in FIG. 2, for accommodating the rotation of the first pin 24.

To reload the carrier 20 back into the base 10, the carrier 20 is positioned at a particular angle with respect to the base 10 to align the length of the first pin 24 with the first slot 15 and thus allowing the first pin 24 to be fit into the first slot 15. The carrier 20 is then rotated to have the second pin 25 fit into the second slot 16 and thus positioning the carrier 20 in the cavity 13 of the base 10.

Figure 3:
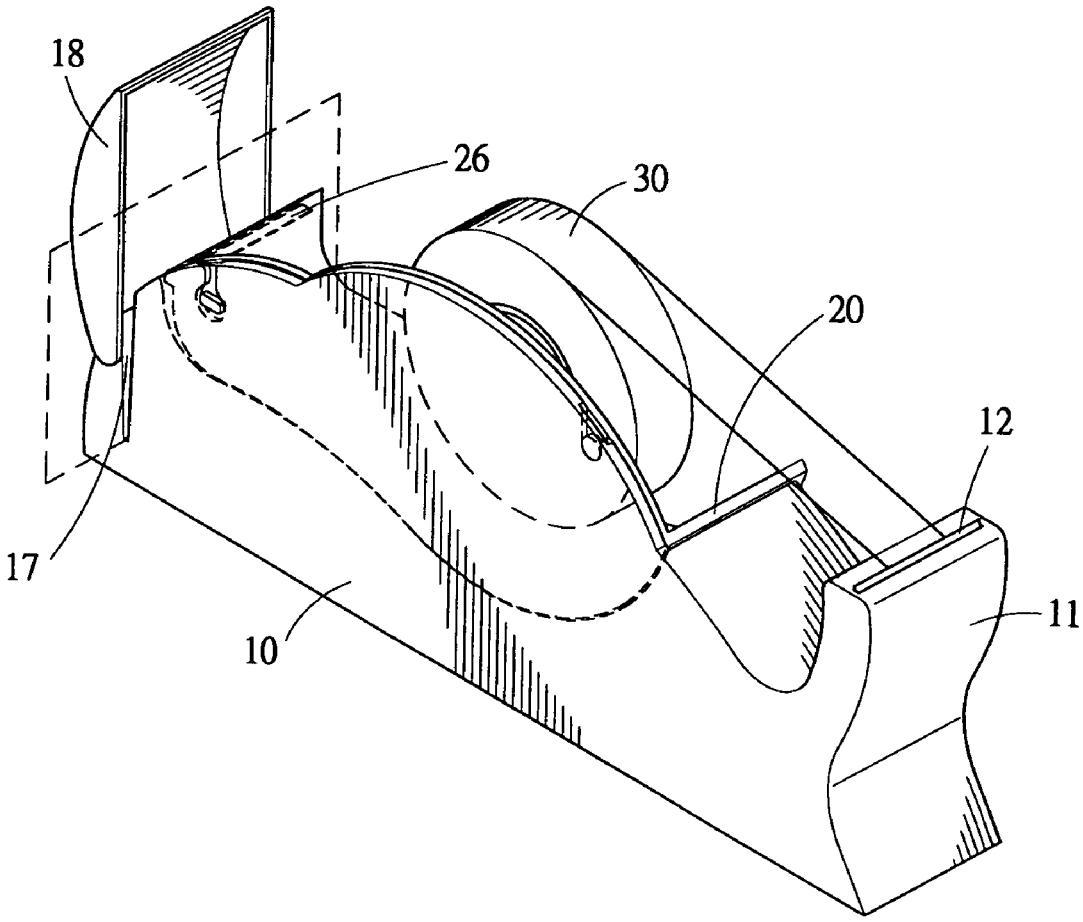
FIG. 3 is a perspective view of the tape dispenser of the present invention, illustrating an additional application of the tape dispenser.

Further referring to FIG. 3, a slit 17 is defined in the rear end of the base 10 for selectively receiving and retaining a card or a note, as illustrated in phantom lines in FIG. 3. This provides an additional function for the tape dispenser. Further, a lid 18 is pivoted to the rear end of the base 10 for shielding the sharp edge of the secondary cutter 26 and protecting a user from being hurt by the secondary cutter 26 when the tape dispenser is in the fixed operation mode.

To conclude, mounting the movable carrier 20 to the base 10 in a removable manner allows the tape dispenser to be used in either the fixed mode or the movable mode. This provides flexibility of use of the tape dispenser. In addition, in the limited space of the tape dispenser, an additional function is provided by forming a slit 17 in the base 10 to receive and retain a card or a note.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A tape dispenser comprising:

a base having opposite front and rear ends and a top face, the front end forming a cutter holder in which a first cutter is mounted with a sharp edge projecting above a top of the cutter holder, a side wall extending alongside and from the top face of the base to form a first cavity with the top face, first and second slots being defined in the side wall and extending from a top edge of the side wall; and a movable tape carrier having a bottom complementary in shape to and positioned on the top face of the base to have the carrier received in the first cavity of the base, a second side wall extending from the bottom to define a second cavity in which an axle is mounted for rotatably supporting a roll of tape in the second cavity, first and second pins formed in the second side wall and movably received in the first and second slots to releasably retain the carrier in the first cavity, a second cutter mounted to a rear end of the carrier;

wherein the releasable retention of the movable carrier in the base allows for the dispenser to be selectively used in a fixed operation mode by fixing the carrier in the base and a movable operation mode by separating the carrier from the base.

2. The tape dispenser as claimed in claim 1, wherein the rear end of the base defines a slit adapted to receive and retain a card.

3. The adjusting device as claimed in claim 1 further comprising a lid rotatably mounted to the rear end of the base for shielding the second cutter.

4. The tape dispenser as claimed in claim 1, wherein the first pin is elongated and wherein the first slot terminates at an expanded hole for smooth rotation of the elongated first pin therein, whereby when the carrier is at a predetermined angular position with respect to the base, the length of the first pin substantially aligns with the extension direction of the first slot to allow for withdrawal of the first pin out of the first slot.

* * * * *